United States Patent [19]

Lautenschläger, Jr.

[11] Patent Number: 4,799,290

[45] Date of Patent: Jan. 24, 1989

[54] CABINET HINGE

[75] Inventor: Karl Lautenschläger, Jr., Reinheim, Fed. Rep. of Germany

[73] Assignee: Karl Lautenschlager GmbH & Co. KG Mobelbeschlagfabrik, Reinheim, Fed. Rep. of Germany

[21] Appl. No.: 886,259

[22] Filed: Jul. 15, 1986

[30] Foreign Application Priority Data

Jul. 16, 1985 [DE] Fed. Rep. of Germany ..... 3525279

[51] Int. Cl.[4] ..... E05D 7/06; E05D 7/12

[52] U.S. Cl. ..... 16/237; 16/241; 16/246; 16/258; 16/268; 16/327; 16/355; 16/382

[58] Field of Search ..... 16/236, 238, 237, 240, 16/241, 245, 246, 258, 270, 326, 268, 327, 355, 382; 292/207, 209, 248, 249; 403/166, 353

[56] References Cited

U.S. PATENT DOCUMENTS 4,045,841 9/1977 Röck ..... 16/129
4,590,641 5/1986 Lautenschläger et al. ..... 16/238

FOREIGN PATENT DOCUMENTS 3119571 12/1982 Fed. Rep. of Germany .
2307107 12/1976 France ..... 16/352

*Primary Examiner*—Fred Silverberg
*Assistant Examiner*—Edward A. Brown

[57] ABSTRACT

Cabinet hinge whose mounting plate serving for the adjustable attachment of the carcase-related part of the hinge to the carcase of a cabinet is composed of two parts, i.e., of a bottom plate and a top plate. The bottom plate has in its outer end adjacent the door at least one hook rising from the plane in which it is fastened to the carcase and pointing outwardly, which can engage an associated eye in the bottom of the upper plate. The confronting surfaces of engagement between the hook and the eye are of complementary configuration and at least approximately arcuate with the centers of the arcs coinciding approximately with the center of the angular displacement described by the hinge in the first part of its closing movement relative to the door-related part of the hinge. A spring catch mechanism with a handle is provided in the bottom plate for the purpose of the releasable attachment of the top and bottom plates to one another.

7 Claims, 3 Drawing Sheets

CABINET HINGE

BACKGROUND OF THE INVENTION

The invention relates to a hinge for hanging a door on a cabinet. The hinge has a door-related part which can be fastened to the door, and a carcase-related part coupled pivotingly by a linkage to the door-related part; the carcase-related part can be mounted adjustably on a mounting base assembly which can be fastened to the carcase wall and which is composed of two plates, separable from one another, of which the bottom plate, which is placed against the carcase wall, can be fastened fixedly thereon, and the top plate can be joined to the bottom plate by a spring catch mechanism.

When very large doors, for example wardrobe doors, are to be hung with modern articulated hinges, at least three, but often even four or five hinges are required. The attachment to the carcase of the hinges premounted on the doors then requires that the carcase-related parts, which are usually in the form of elongated supporting arms, be slipped onto the mounting plates previously installed on the carcase. In the case of the known hinges, the heads of mounting screws driven into taps in the base plate are passed through the enlarged ends of keyhole-like slots in the supporting arms, the mounting screws are slid in the narrow portion of the keyhole slots to the correct mounting position, and then the mounting screws are tightened. At the same time the depth adjustment of the hinges is performed by means of these mounting screws and, in the case of overlap doors, the amount by which the door overlaps the edges of the carcase also requires that the mounting screws be loosened and that an adjustment be made by means of an additional adjusting screw. Consequently, the hanging of the door and the adjustment of the supporting arms, which present no problems in the case of doors hung with only two hinges, become difficult tasks in the case of the larger doors, because, until the mounting screws are tightened, the weight of the door, which is open while it is being hung and adjusted, tends to pull at least the supporting arms of the upper hinges forward, i.e., away from the cabinet interior, so that the danger is that the mounting screws will escape from the keyhole slots. As a rule, therefore, two persons are needed for the tasks of hanging and adjusting doors provided with more than two hinges, and even then the installation of these doors is difficult and time-consuming until the correct adjustment and fixation is completed.

A simplification of the hanging of the door on the carcase of a cabinet has been achieved with hinges of the kind described above (DE-OS No. 31 19 571) in which only the bottom plate of a mounting base assembly is fastened to the carcase, while the top plate of the base assembly, which can be snapped onto the bottom plate, is previously mounted on the carcase-related part of the hinge. Then, when the door is hung on the cabinet carcase, all that is needed is to snap the top base plate onto the corresponding bottom base plate. If the carcase-related part of the hinge has been correctly preadjusted on the top mounting plate, it is not even necessary then to perform any alignment of the door relative to the carcase. Despite this improvement, the mounting of a door on a cabinet carcase is still difficult, so that the dismounting and subsequent remounting of a door on a cabinet, e.g., for furniture moving operations, can present difficulties to untrained persons.

The invention is therefore addressed to the problem of improving the known hinges such that hinges attached to the same door can be detached from or attached to the carcase one by one, and consequently by an unassisted person, without requiring difficult manipulations for this purpose.

SUMMARY OF THE INVENTION

Setting out from a hinge of the kind mentioned above, this problem is solved according to the invention in that the bottom plate of the mounting plate assembly has in its front end area adjacent the door at least one hook projecting upwardly from the plane of its attachment to the cabinet carcase and away from the carcase interior, and capable of engaging an associated eye in the bottom of the upper plate of the mounting base assembly. The surfaces of contact between hook and eye are of complementary and at least approximately arcuate configuration. The center of curvature of the arcuate engagement surface of the hook is approximately the same point as the center of the path of movement of the arcuate engagement surface of the eye at the beginning of the movement from the open position in closing direction of the hinge. The spring catch mechanism is provided with a handle for its release, this handle being situated deeper within the cabinet than the inner end of the wall-related part of the hinge. When a door that is to be hung on a cabinet with more than two of these hinges, first only the carcase-related parts of the uppermost and lowermost hinges are turned to the open position and the door is then set against the carcase such that the top plates of the uppermost and lowermost mounting plate assemblies are snapped onto the corresponding bottom plates previously installed on the carcase. The door is thus temporarily held by these two hinges in correct alignment with the carcase. Then all that remains is to turn the carcase-related parts of the rest of the hinges, together with the top plates of their mounting base assemblies preinstalled on them, into the open position, and they will automatically then be guided so that the top plates can be snapped each onto their corresponding bottom plates. To dismount the door the procedure is reversed, i.e., with the door open, first the hinges between the uppermost and lowermost hinges are individually unsnapped by acting on the handles, and the carcase-related hinge parts together with the top mounting plates are swung into the closed position. The final removal of the door is then performed by unsnapping the top mounting plates of the uppermost and lowermost hinges while providing, preferably, additional support for the door. The provision of a spring catch mechanism between the top and bottom plates of the mounting base assembly hs the basic advantage over the likewise conceivable similar arrangement between the carcase-related part of the hinge and a mounting plate, which could then even be a one-piece unit, that the top member of the mounting base assembly on which the carcase-related hinge part is fastened is identical with the conventional mounting plates, i.e., the kind that cannot be unsnapped, so that the hinges formerly used in conjunction with normal mounting plates can continue to be used without modification.

When the mounting base assembly has the form of a wing plate having wing-like projections extending from opposite sides of an elongated central bridge, which are fastenable to the carcase, the configuration can be such, in an advantageous further development of the invention, that the top plate of the mounting base assembly overlaps the bottom plate thereof in the area of the wings, and that a hook projection as well as its corresponding eye are provided one in each of the overlapping portions of the top and bottom plates of the mounting base assembly.

The bottom plate of the mounting base assembly is prolonged at its inner end in the direction of the carcase interior, and the handle is disposed in this prolonged portion and joined to a catch projection which is held for longitudinal displacement in the bottom plate of the mounting base assembly and which snaps resiliently over a catch projection on the upper mounting plate. The handle is thus easily accessible for disengagement. In an advantageous development of the invention, the handle and the catch projection associated with it are then disposed on a slide which is held for longitudinal displacement in a slot in the bottom mounting plate, but secured against escape therefrom, and is biased to the position of engagement by a spring engaging the bottom plate at one end and the slide itself at the other.

Mounting plates which are provided with wings for fastening are often fastened by using bores sometimes provided in rows in the cabinet carcase for the accommodation of shelf supports and the like. In the bottom mounting plate a hole is then provided through each wing as well as through the prolongation toward the cabinet interior for a screw to be driven into the carcase. The screws to be driven through the holes in the wings of the mounting plate assembly are then driven into the bores sometimes provided, as mentioned above, while the screw to be driven through the hole additionally provided in the prolongation toward the cabinet interior is then driven into a bore that is to be created separately. The screw holes can be in the form of slots running parallel to the hinge axis of rotation in order thus to permit adjustment of the level of the mounting plate and hence of the door with respect to the cabinet.

Since the top mounting plate must be detachable and removable from the bottom mounting plate, it must not be held against the bottom member by the heads of the screws. Consequently the holes or slots provided in the wings of the top plates in line with those in the bottom plates are made with a diameter larger than the heads of the corresponding screws.

SUMMARY OF THE DRAWING

The invention is further explained in the following description of an embodiment in conjunction with the drawing, wherein.

DESCRIPTION OF A PREFERRED EMBODIMENT

Figure 1:
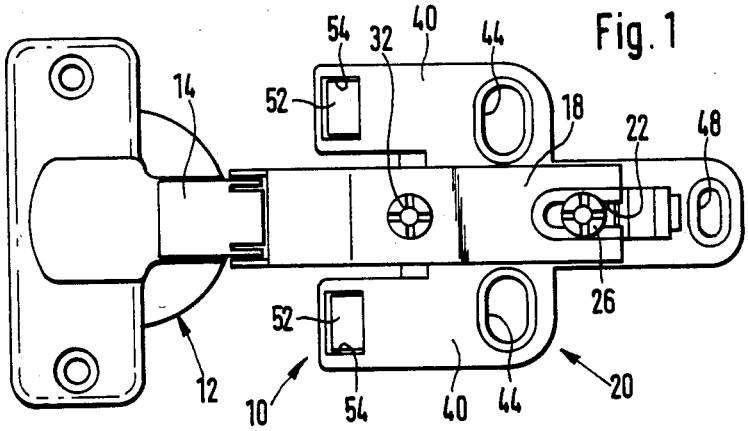
FIGS. 1 and 2 are a top view and side view, respectively, of a hinge constructed in the manner of the invention.
Figure 2:
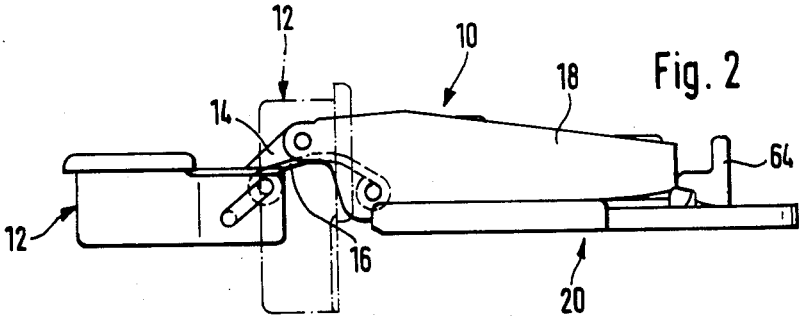

The hinge shown in FIGS. 1 and 2 and designated as a whole by the number 10 serves, in conjunction with other hinges of the same design, for hanging a door on the wall of a cabinet carcase, such as for example a bedroom wardrobe with a correspondingly large door which, on account of its weight, has to be hung with at least three hinges 10 at different levels.

Figure 3:
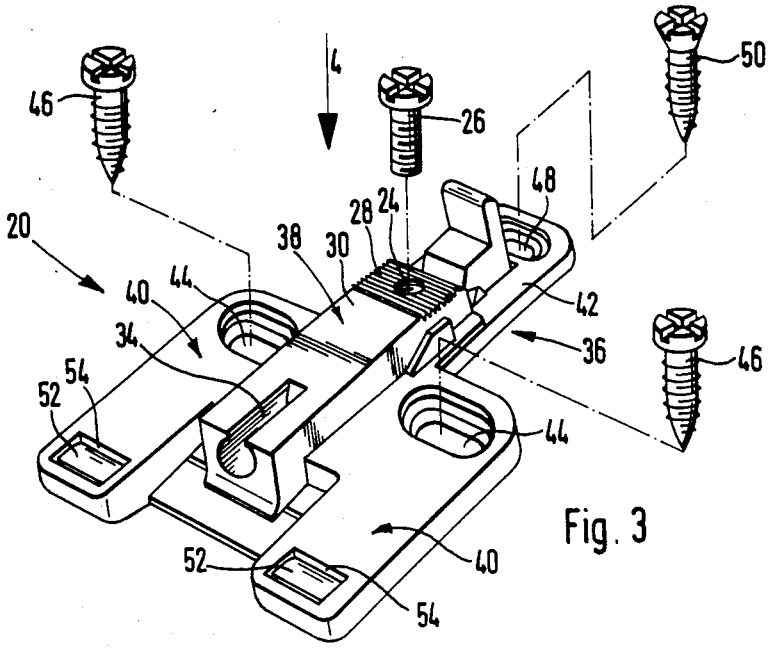
FIG. 3 is a perspective view of the mounting base assembly of the hinge shown in FIGS. 1 and 2.
Figure 4:
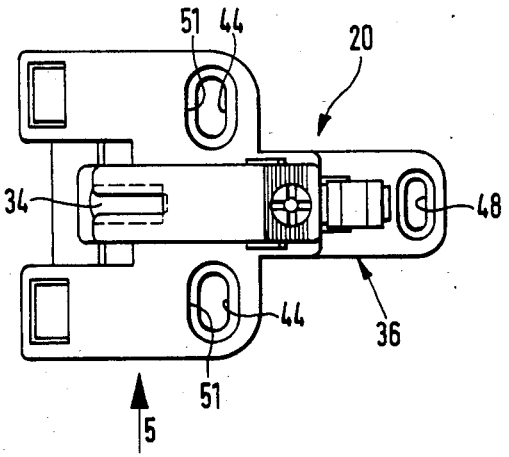
FIG. 4 is a top plan view of the mounting base assembly as seen in the direction of the arrow 4 in Figure 3.
Figure 5:
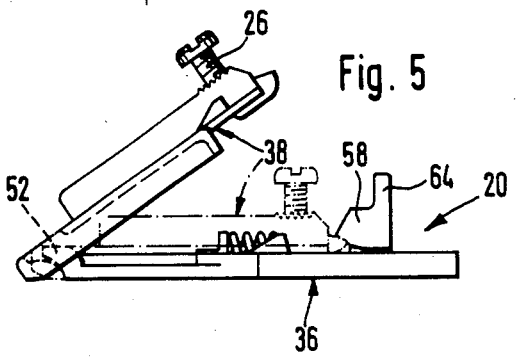
FIG. 5 is a side view of the mounting base assembly as seen in the direction of the arrow 5 in FIG. 4.
Figure 6:
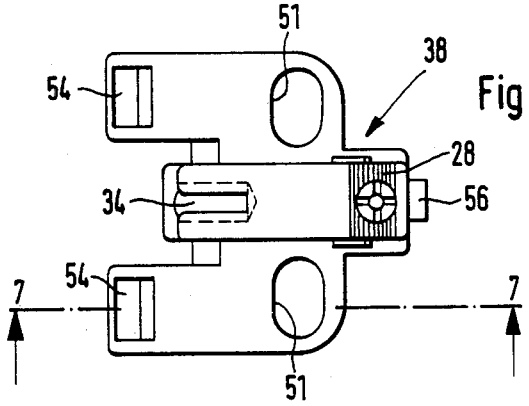
FIG. 6 is a top plan view of the upper part of the mounting base assembly shown in FIGS. 4 and 5.
Figure 7:
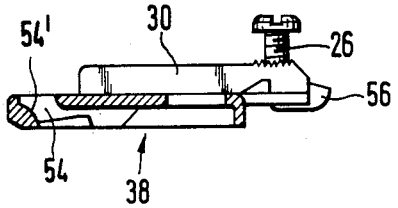
FIG. 7 is a sectional view seen in the direction of the arrows 7—7 in FIG. 6.

The hinge 10 is in the form of a common four-joint hinge. Its door-related part, in the form of a cup 12 which can be fastened flush within a mortise in the back of the door, is coupled by two links 14 and 16 with the front end of a carcase-related hinge part which is an elongated supporting arm 18, which in turn is adjustably mounted on a mounting base assembly 20 (FIGS. 3 to 5) which can be fastened to the carcase. To enable it to be fastened for longitudinal adjustment on the mounting base assembly, the supporting arm has at its inside end, i.e., the end pointing into the interior of the carcase, an open-ended slot 22 through which passes the threaded shaft of a fastening screw 26 driven into a tap 24 in the mounting base assembly. The head of the screw, when driven all the way into the tap 24, presses the inner end of the supporting arm 18, whose inside face is provided with transverse serrations (not shown), against a portion provided with complementary serrations 28 of a raised, elongated guiding bridge 30 of the mounting base assembly 20, thus securing the supporting arm 18 against lengthwise displacement on the bridge 30. A threaded spindle 32 is set in a tap in the bridge of the supporting arm 18 at a point offset toward the cup 12 with respect to the slot 22, and has at its inner, mounting base assembly end a holding head—a spherical holding head for example—connected to it by a neck of reduced diameter, which is inserted into an open-ended bore 34 of complementary cross sectional shape running from the end face of the bridge 30, the bore 34 being slotted at the top to accommodate the neck. This threaded spindle 32 serves for the adjustment of the inclination of the supporting arm 18 relative to the carcase wall and thus for the variation of the amount of overlap of the door on the end of the carcase wall.

It is apparent that, by turning the threaded spindle 32, while the fastening screw 26 is loosened slightly, it is possible to vary the angular adjustment of the supporting arm on the mounting base assembly 20.

Figure 8:
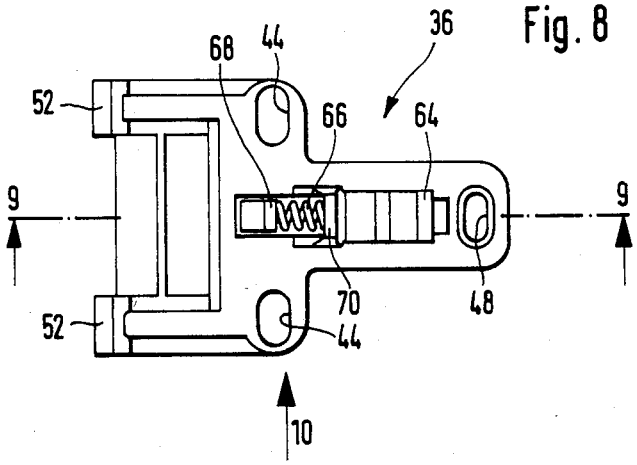
FIG. 8 is a top view of the bottom plate of the mounting base assembly shown in FIGS. 4 and 5.
Figure 9:
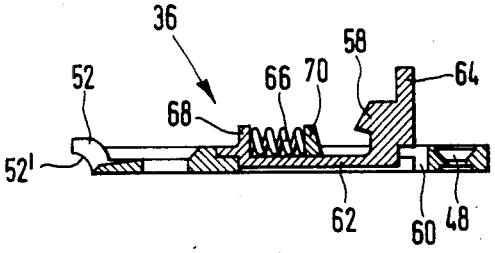
FIG. 9 is a sectional view seen in the direction of the arrows 9—9 in FIG. 8.
Figure 10:
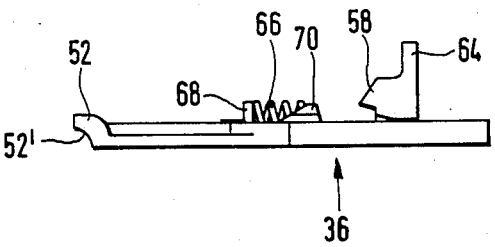
FIG. 10 is a side view of the bottom part of the mounting base assembly seen in the direction of the arrow 10 in FIG. 8.

Except for the mounting base assembly 20, the hinge 10 is the same as the known four-pivot hinges, so that it will suffice hereinafter to describe the special configuration of the mounting base assembly and its adaptation to the motion of the hinge. The mounting base assembly 20 is composed of two pieces, namely a flat bottom plate 36 to be fastened directly to the wall of the carcase (FIGS. 8 to 10) and a top plate 38 snapped onto the bottom mounting plate 36. In the embodiment shown, the mounting base assembly 20 is a so-called wing base, in which a wing 40 projects from each side of the bridge 30 serving for the adjustable mounting of the supporting arm 18, and it usually serves for fastening the mounting base assembly to the carcase.

The top plate 38 of the mounting base assembly is fitted over the flat bottom plate 36, while only the inner end 42 of the bottom plate 36 has a prolongation of approximately the width of the bridge 30 in the direction of the carcase interior, i.e., it projects from under the top plate 38. Plate 36 of the mounting base assembly is fastened on the carcase wall by means of screws 46 passed one through each of the slots 44 formed in the wings 40, and an additional screw 50 passed through an additional slot provided in the prolonged end 42, the slots 44 and 48 permitting a certain adjustment of the level of the bottom plate 36 and thus of the mounting base assembly 20 on the carcase wall. In the wing area above the slots 44, the upper plate 38 of the mounting base assembly is provided with slots 51 which are larger than slots 44, so as to permit the heads of the mounting screws 46 to be driven through the slots 51 against the surface of the bottom plate 36 of the mounting base assembly.

For the releasable attachment of the top plate 38 to the bottom plate 36, a hook-like projection 52 is provided at the front margin, adjacent the door, of each of the wings of bottom plate 36, which can engage an associated eye 54 in the wings of the top plate 38. The associated engagement surfaces 52' and 54' of the hook-like projection 52 and eye 54, respectively, are of complementary arcuate shape, the centers of the arcs coinciding at least approximately with the center of the relative angular movement of the supporting arm and cup. A catch projection 56 extends from center of the inside end, i.e., the end pointing toward the cabinet interior, of the top plate 38, and with it there is associated a catch projection 58 which can ride over it and which is longitudinally displaceable at the rearward end of a slide 62 which is guided within a slot 60 in the bottom plate 36, but secured against escaping from the latter. The inside end of the slide 62 lies in the prolonged portion 42 of the bottom plate 36 which is not covered by the upper plate 38, so that an upstanding handle 64 is freely accessible for the purpose of shifting the slide 62 and thus the catch projection 58 toward the interior of the cabinet, and thus releasing the catch projection 58 from the catch projection 56. The slide is biased to the catching position by a compression spring which is disposed between a projection 68 of the slide and a projection 70 of the bottom plate 36.

The hanging of a door on a cabinet by means of the hinges 10 according to the invention is performed such that the hinges preinstalled on the door, except for the bottom plates 36 fastened by means of screws 46 and 50 to the carcase, are carried along with the door to the carcase in a position corresponding approximately to the open position of the door, while the carcase-related hinge parts, i.e., the supporting arms 18, with the top plates 38 fastened to them, are in the closed position or an intermediate position. In order to fasten each hinge to the carcase, the supporting arms then need only to be swung into the open-hinge position, bringing the hook-like projections 52 into engagement with the eyes 54. As the supporting arm is further rotated toward the carcase wall, the catch projection 56 on the top plate strikes against the resiliently biased catch projection 58, and displaces it against the spring bias until finally the catch projection 58 snaps over the catch projection 56. Thus the hinge in question is held fast to the carcase, the tight fastening together of the two plates 36 and 38 being assured by an appropriate angling of the overlapping surfaces of the catch projections. The hinges are fastened one by one in the manner described by turning them, so that at most at the beginning of the assembly operation a second person is needed to hold the door up. When disassembly becomes necessary, the procedure is reversed, i.e., first the catch projections 56 and 58 are disengaged from one another by pressing the handles 64 toward the interior of the cabinet and thus shifting the slide 62 against the bias of spring 66 toward the cabinet interior. The catch projections thus become disengaged. Then the supporting arm 18 of the particular hinge is turned away from the carcase wall, which is easily possible on account of the selected cinematic relationship between the engaging surfaces 52' and 54' and the movement of the hinge, even if the door is still held on the cabinet by two or more other hinges.

It is obvious that, within the scope of the invention, modifications and further developments of the described hinge and of the mounting base assembly of the hinge can be realized, which can relate to the way in which the bottom plate 36 is fastened to the carcase and to the manner in which the supporting arm 18 is adjustably mounted on the top plate 38. It is essential only that the mounting base assembly is composed of two plates which can be joined to one another or separated from one another, and that, in assembly and disassembly, they perform a movement which, due to the special formation of the elements holding them together, substantially coincides with the angular movement of the corresponding hinge.

I claim:

1. A hinge for hanging a door on a carcase of a piece of furniture, said hinge having a door-related hinge part fastenable to a door, and a carcase-related hinge part, a linkage mechanism coupling said carcase-related hinge part to said door-related hinge part so as to be pivotable about a hinge pivot axis from an open to a closed position and vice versa, mounting plate means fastenable to a carcase, said mounting plate means comprising two parts separable from one another: a first mounting plate part having a face to be affixed to the carcase, and a second mounting plate part for adjustable holding said carcase-related hinge part, said first mounting plate part having adjacent said door-related hinge part at least one hook projection projecting from said face toward said door-related part, and at least one associated hook socket in said second mounting plate part, said at least one hook projection and hook socket having associated arcuate engagement surfaces of at least approximately the same radius, center of curvature of the arcuate engagement surface of said hook projection being approximately the same point as the center of the path of movement of the arcuate engagement surface of said hook socket at the beginning of the movement from the open position in closing direction of said hinge, whereby said hook socket snaps into engagement with said hook projection and said second mounting plate part into engagement with said first mounting plate part during assembly, and a spring catch mechanism interconnecting said two mounting plate parts together, said spring catch mechanism having a handle remote from said door-related hinge part for unlocking said catch mechanism.

2. A hinge according to claim 1, in which said mounting plate means is a wing plate with wing appendages which project from opposite sides of an elongated central stick-shaped supporting-arm-mounting section, said second mounting plate part overlapping said first mounting plate part in the area of said wing appendages, one hook projection and one associated hook socket being provided in each of the overlapping areas of said first and second mounting plate parts, respectively.

3. A hinge according to claim 2, wherein said first mounting plate part has an extension away from said door-related hinge part, said handle being disposed in said extension, connected to a catch projection mounted longitudinally displaceably on said first mounting plate part, and resiliently catching on a catch projection on said second mounting plate part.

4. A hinge according to claim 3, wherein said handle and said catch projection connected thereto are disposed on a slide guided longitudinally displaceably in an elongated opening in said first mounting plate part and guided securely against lifting, a spring engaging said first mounting plate part at one end and said slide on the other and biasing said slide toward a catch engagement position.

5. A hinge according to claim 3, wherein said first mounting plate part has, in the area of each wing appendage and in said extension a passage opening for a fastening screw to be threaded into the carcase.

6. A hinge according to claim 5, wherein said passage openings are slots running parallel to said hinge pivot axis.

7. A hinge according to claim 6, wherein said second mounting plate part has in the area overlapping the openings in said first mounting plate part through-openings aligned with said openings and having a diameter slightly greater than the diameter of the head of the fastening screw to be threaded into the carcase.

* * * * *